US006538526B2

(12) United States Patent
Mikami et al.

(10) Patent No.: US 6,538,526 B2
(45) Date of Patent: Mar. 25, 2003

(54) TRANSMISSION LINE CONNECTION STRUCTURE, HIGH FREQUENCY MODULE, AND COMMUNICATION DEVICE

(75) Inventors: Shigeyuki Mikami, Kyoto-fu (JP); Toshiro Hiratsuka, Kyoto-fu (JP); Tomiya Sonoda, Kyoto-fu (JP); Kiyoshi Kanagawa, Kyoto-fu (JP)

(73) Assignee: Murata Manufacturing Co. Ltd (JP)

( * ) Notice: Subject to any disclaimer, the term of this patent is extended or adjusted under 35 U.S.C. 154(b) by 0 days.

(21) Appl. No.: 09/837,776

(22) Filed: Apr. 18, 2001

(65) Prior Publication Data

US 2002/0027486 A1 Mar. 7, 2002

(30) Foreign Application Priority Data

Apr. 18, 2000 (JP) ..... 2000-116209

(51) Int. Cl.[7] ..... H01P 5/02
(52) U.S. Cl. ..... 333/24 R; 333/219; 333/260
(58) Field of Search ..... 333/202, 208, 333/219, 254, 246, 219.1, 260, 24 R

(56) References Cited

U.S. PATENT DOCUMENTS

| | | | | |
|---|---|---|---|---|
| 5,484,764 A | * | 1/1996 | Fiediuszko et al. | 333/202 |
| 5,943,005 A | * | 8/1999 | Tanizaki et al. | 333/202 |
| 5,986,519 A | | 11/1999 | Kellett et al. | 333/120 |
| 5,990,764 A | * | 11/1999 | Tanizaki et al. | 333/202 |
| 6,144,267 A | * | 11/2000 | Saitoh et al. | 333/1.1 |
| 6,201,456 B1 | * | 3/2001 | Hiratsuka et al. | 333/134 |

FOREIGN PATENT DOCUMENTS

| | | |
|---|---|---|
| DE | 3426565 | 1/1986 |
| EP | 0367543 | 5/1990 |
| EP | 0473981 | 3/1992 |
| EP | 0973226 | 1/2000 |

OTHER PUBLICATIONS

Hoffmann Reinmut K: "Integrierte Mikrowellenschaltungen" 1983, Springer Verlag, Berlin Heidelberg New York Tokyo XP002171109; ISBN: 3–540–12352–0; p. 92, paragraph 1.7.1–p. 96; p. 309, paragraph 11.1–p. 311; p. 321, paragraph 11.3.2–p. 322.

Hajime Izumi, et al., "Ribbon–Wire Interconnect Using Parasitic Element", *1998 General Conference of the Institute of Electronics, Information and Communication Engineers* C–2–77.

Hajime Izumi, et al., "Ribbon–Wire Interconnect Using Parasitic Element", *1998 Asia Pacific Microwave Conference*, pp. 499–500, 1998.

* cited by examiner

*Primary Examiner*—Seungsook Ham
(74) *Attorney, Agent, or Firm*—Dickstein, Shapiro, Morin & Oshinsky, LLP.

(57) ABSTRACT

Electrodes having slot patterns, electrodes having strip patterns, or dielectric strips, for example, form transmission lines and resonator patterns on the upper faces of dielectric substrates or conductive substrates, for example. Resonators formed by the resonator patterns are arranged at the ends of the transmission lines at the end portions of the substrates. A pair of the resonators are electromagnetically coupled to each other, whereby the corresponding transmission lines are also connected to each other.

12 Claims, 13 Drawing Sheets

TRANSMISSION LINE CONNECTION STRUCTURE, HIGH FREQUENCY MODULE, AND COMMUNICATION DEVICE

BACKGROUND OF THE INVENTION

1. Field of the Invention

The present invention relates to a transmission line connection structure for use in a high frequency band such as a microwave band, a millimeter wave band or the like, a high frequency module provided with the transmission line connection structure, and a communication device using the module.

2. Description of the Related Art

Ordinarily, when a high frequency module is made up of discrete parts, it is necessary to connect transmission lines between the respective parts. Conventionally, connections between micro-strip lines, and connections between slot lines, are carried out by wire or ribbon bonding or the like.

FIGS. 11A and 11B show a conventional connection structure between micro strip lines. FIG. 11A is a perspective view of the connection structure. FIG. 11B is a plan view thereof. Here, strips 5*a* and 5*b* made of conductive patterns are formed on the upper faces of dielectric substrates 1*a* and 1*b*, respectively, and ground electrodes are formed on the under faces, whereby micro strip lines are formed. The end faces of the dielectric substrates constituting the two micro strip lines are opposed to each other, and the strips 5*a* and 5*b* are connected by bonding with a wire 15.

FIGS. 12A and 12B illustrate a connection structure between slot lines. FIG. 12A is a perspective view of the connection structure. FIG. 12B is a plan view thereof. Electrodes 2*a* and 2*b* having slots 3*a* and 3*b* are formed on the upper faces of the dielectric substrates 1*a* and 1*b*, whereby slot lines are formed, respectively. The end faces of the two dielectric substrates 1*a* and 1*b* constituting the slot lines, respectively, are opposed to each other, and the electrodes are connected by the wires 12.

FIG. 13 shows the return loss characteristics of transmission line connection structures in which the connection wires are provided in two different positions.

The connection structure in which the transmission lines are connected by wire or ribbon bonding, as described above, is greatly affected by a parasitic component caused by the connection of the wire or ribbon. For example, the impedances of the transmission lines may be mismatched in the connection portion, and the electromagnetic field distribution of the transmission mode may be disturbed. As a result, the electrical characteristics of the connection portion are deteriorated, and the return loss becomes significant as seen in FIG. 13. Especially, in a high frequency band such as a millimeter wave band or the like, the characteristics in the connection portion of the transmission lines are considerably deteriorated. This is one of the factors that reduce the performance of a module, or of a whole apparatus including the module.

Moreover, the structure in which transmission lines are connected by wire or ribbon bonding can suffer stress in the connection portion, which is caused by environmental changes or the like. As a result, the wire or ribbon is cut and the connection characteristic is changed. This may be another factor which causes the reliability to decrease.

Moreover, in the case of the connection structure obtained by wire or ribbon bonding, the connection between the transmission lines is fixed. Accordingly, once the transmission lines are connected to each other, parts equipped with the transmission lines can not be cut and separated from each other. Thus, problematically, adjustment or exchange on a part unit level is impossible.

SUMMARY OF THE INVENTION

In order to address the foregoing problems, the present invention provides a transmission line connection structure which prevents deterioration of the characteristic in the connection portion between transmission lines, solves problems such as reduction of the reliability in a bonding portion, change of the connection characteristic or the like, caused by environmental changes, and allows connection or disconnection between the transmission lines to be repeatedly carried out. The invention also provides a high frequency module provided with the transmission line connection structure, and a communication device using the module.

According to an aspect of the present invention, there is provided a transmission line connection structure in which transmission lines each having a predetermined structural body are connected to each other. Resonators connected to the ends of the transmission lines are arranged at the end portions of the respective structural bodies, and the end portions of the structural bodies of the transmission lines to be connected are positioned near to each other, whereby the resonators are electromagnetically coupled to each other. In this structure, it is unnecessary to connect the conductors of the two transmission lines by use of a wire or ribbon. That is, the transmission lines can be connected, without being affected by a parasitic component caused by the wire or ribbon. Moreover, in the structure, the transmission lines are arranged in such a manner that the resonators at the ends of the transmission lines are positioned near to each other. Thus, the connection and disconnection of the transmission lines can be repeatedly carried out.

The transmission lines may each advantageously comprise an electrode having a slot pattern formed on a dielectric substrate, e.g., as slot lines, fin lines, plane dielectric transmission lines (hereinafter referred to as PDTL, briefly) each comprising a dielectric substrate having slot patterns formed on both of the faces of the substrate in opposition to each other, and so forth.

Also advantageously, the transmission lines may each comprise strip-shaped electrodes formed on a dielectric substrate, e.g., as strip lines, micro strip lines, coplanar guides, suspended lines, and so forth.

Moreover, advantageously, the transmission lines may each comprise a dielectric strip arranged between two substantially parallel conductor planes, forming dielectric transmission lines.

The two transmission lines to be connected may have any one of the above structures. Also, different types of transmission lines may be connected. For example, a slot line and a micro strip line may be connected to each other.

Moreover, according to the present invention, a high frequency module may be formed, in which the above-described transmission line connection structure is applied to transmission lines to be connected between the various module components.

Furthermore, according to the present invention, a communication device such as a mobile communication device, a millimeter wave radar device, or the like, may be formed, which uses the above-described high frequency module.

Other features and advantages of the present invention will become apparent from the following description of embodiments of the invention which refers to the accompanying drawings, in which like references denote like elements and parts.

BRIEF DESCRIPTION OF THE DRAWING(S)

DETAILED DESCRIPTION OF EMBODIMENTS OF THE INVENTION

A transmission line connection structure of a first embodiment will be described in reference to FIGS. 1A and 1B.

Figure 1A:
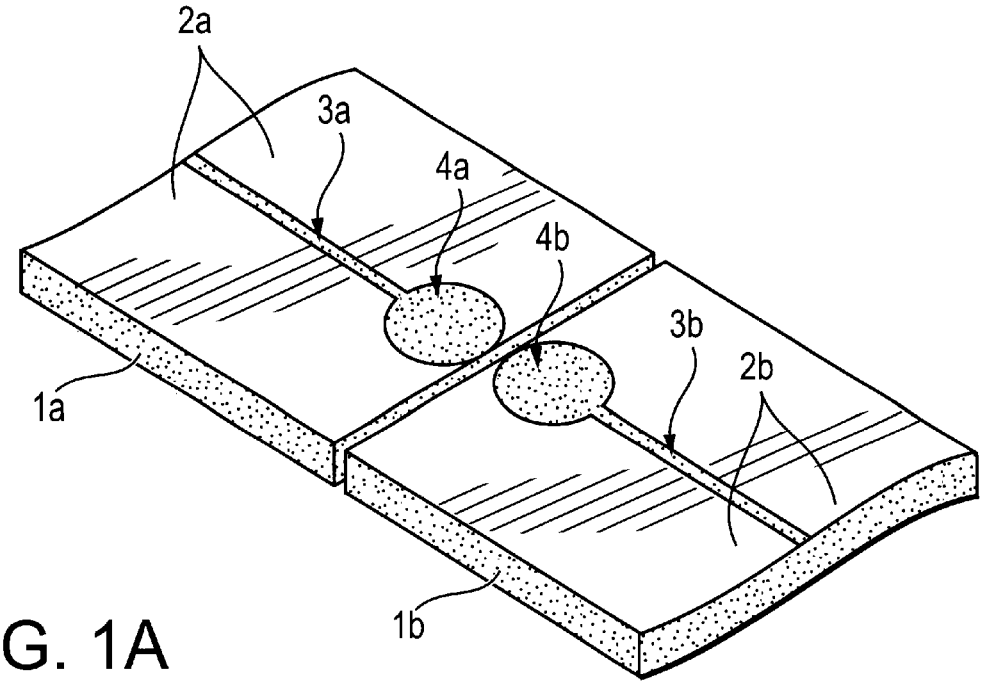
FIGS. 1A and 1B illustrate the configuration of a transmission line connection structure according to a first embodiment of the present invention.
Figure 1B:
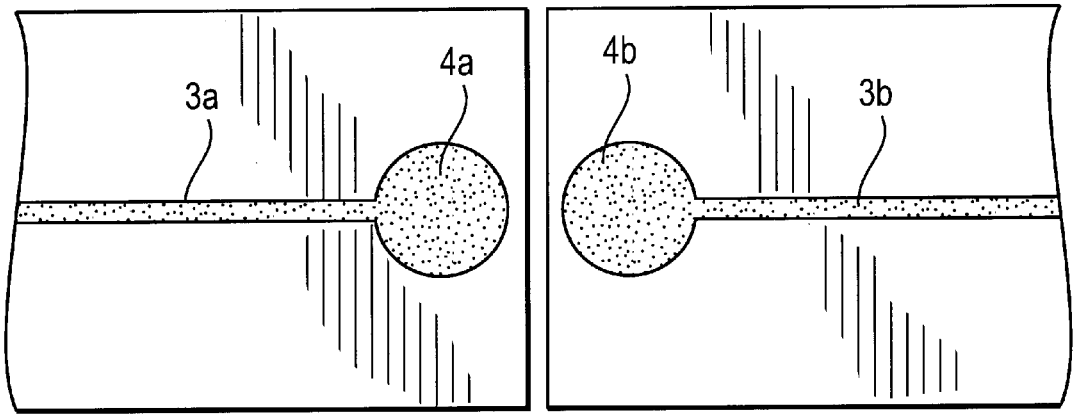

FIG. 1A is a perspective view of the major part of the transmission line connection structure, and FIG. 1B is a plan view thereof. Here, electrodes 2*a* and 2*b* having slot patterns 3*a* and 3*b* are formed on the upper faces of dielectric substrates 1*a* and 1*b*, respectively. The electrodes 2*a* and 2*b* having the slot patterns 3*a* and 3*b*, and the dielectric substrates 1*a* and 1*b* constitute slot lines, respectively.

In the end portions opposed to each other of the dielectric substrates 1*a* and 1*b*, areas enlarged into circular shapes are formed in the ends of the slots, respectively. The areas constitute resonators 4*a* and 4*b* operable in an HE110 mode. These two resonators 4*a* and 4*b*, when they are positioned near to each other, are electromagnetically coupled directly to each other. The slot lines and the resonators provided in the ends thereof are directly connected, respectively. That is, the slot lines are connected to each other via coupling between the resonators. In this case, the ends of the dielectric substrates 1*a* and 1*b* may contact each other or may be separated at a predetermined gap. In both of the cases, when the two transmission lines are connected, the ends of the dielectric substrates are disposed at predetermined relative positions. For separation, both of the dielectric substrates may be simply positioned so as to be at a distance from each other.

Figure 2A:
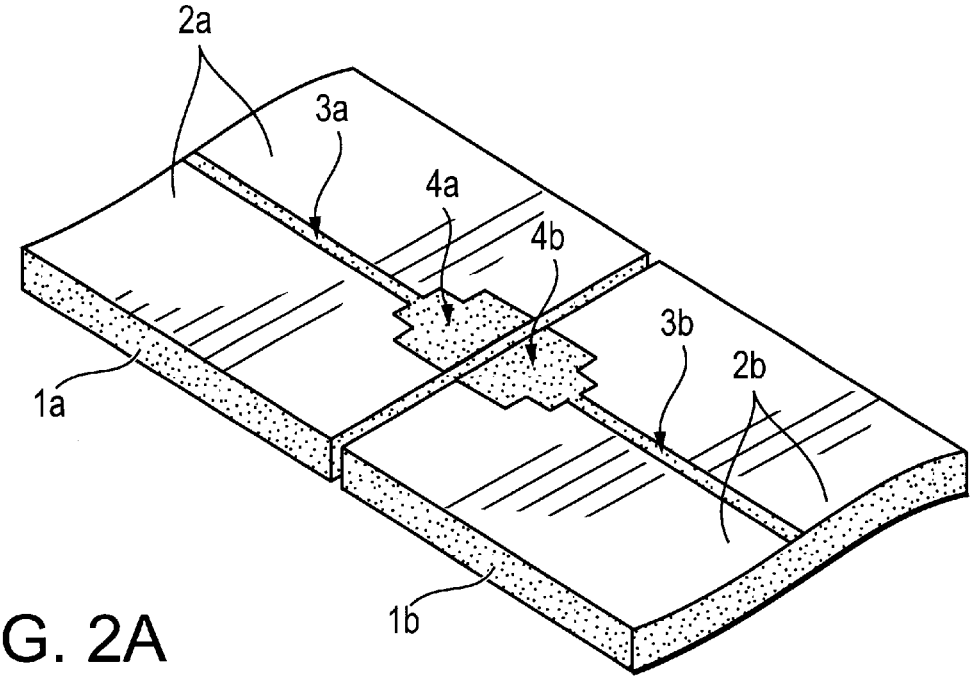
FIGS. 2A and 2B illustrate the configuration of a transmission line connection structure according to a second embodiment of the present invention.
Figure 2B:
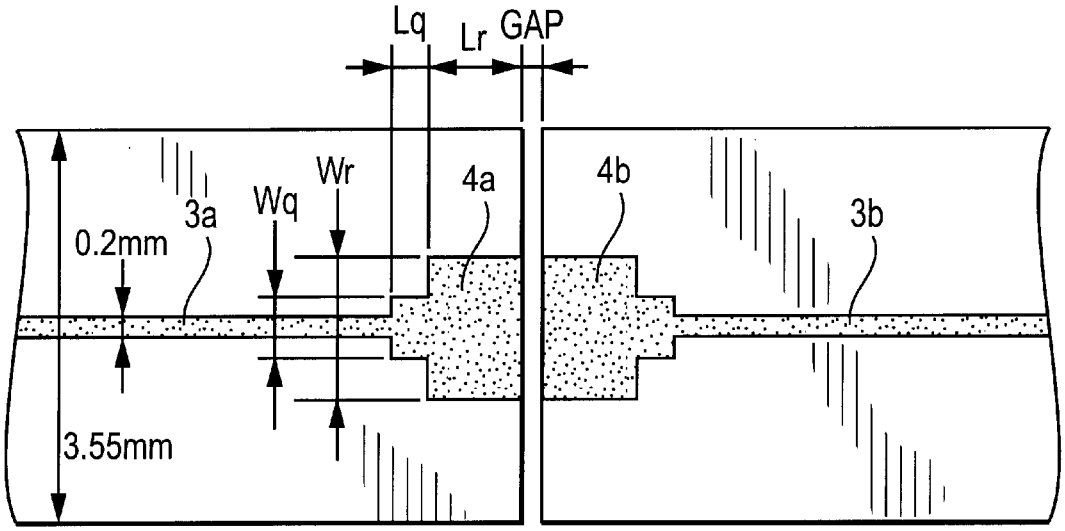

FIGS. 2A and 2B are a perspective view and a plan view showing a transmission line connection structure according to a second embodiment of the present invention. Resonator patterns 4*a* and 4*b* are formed respectively in rectangular patterns, unlike the circular patterns shown in FIGS. 1A and 1B. That is, the resonator patterns 4*a* and 4*b* are formed so as to resonate in a resonance mode different from that of the circular patterns of FIGS. 1A and 1B. In the boundary areas between the resonator patterns 4*a* and 4*b* and the slot patterns 3*a* and 3*b*, the slot widths are gradually widened so that the connection between the resonators and the lines is optimized, respectively. Since the resonator patterns are formed in the rectangular shapes as described above, the opposed areas between the resonators are increased, which enhances the coupling degree.

Figure 3:
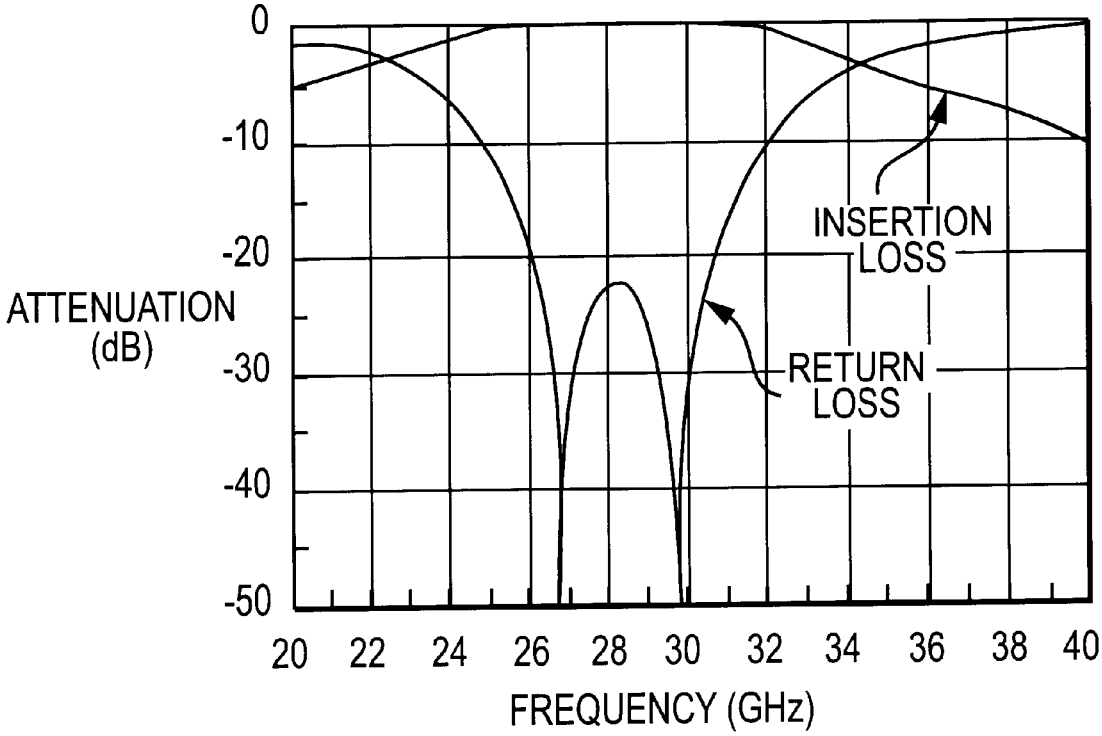
FIG. 3 is a graph showing the frequency characteristic of the transmission line connection structure.

FIG. 3 shows the frequency characteristics of the transmission line connection structure of FIGS. 2A and 2B, obtained when the dimensions of the respective parts shown FIG. 2B are determined as follows.

Wr=1.5 mm

Lr=0.75 mm

Wq=0.5 mm

Lq=0.4 mm gap=0.1 mm

Here, the design frequency is 28.2 GHz. The resonance frequencies of the two resonators are set at 28.2 GHz. In this embodiment, the band in which the return loss RL is less than 20 dB is 26 GHz to 30.7 GHz. The band width ratio is (30.7–26)/28.2=0.166. Thus, the low loss characteristic can be obtained in a wide band having a band width ratio of about 17%.

As described above, the resonators are arranged in the end portions of the structural bodies of the transmission lines. When the two transmission lines are connected, the resonators approach each other and are directly coupled. Thus, the resonators are strongly coupled, so that a low loss characteristic is exhibited in a wide band.

In the examples of FIGS. 1A and 1B and 2A and 2B, the electrodes 2*a* and 2*b* are formed only on the upper faces, as viewed in FIGS. 1A and 1B and 2A and 2B, of the dielectric substrates to form the slot lines and the resonators, respectively. However, the present invention can also be applied to the case in which patterns similar to the slot patterns and the resonator patterns formed on the upper faces are arranged on the under faces in opposition thereto, whereby the transmission line parts comprise PDTL's, respectively.

Moreover, ground electrodes may be formed substantially on the whole of the under faces of the dielectric substrates to form grounded slot lines, respectively.

Figure 14:
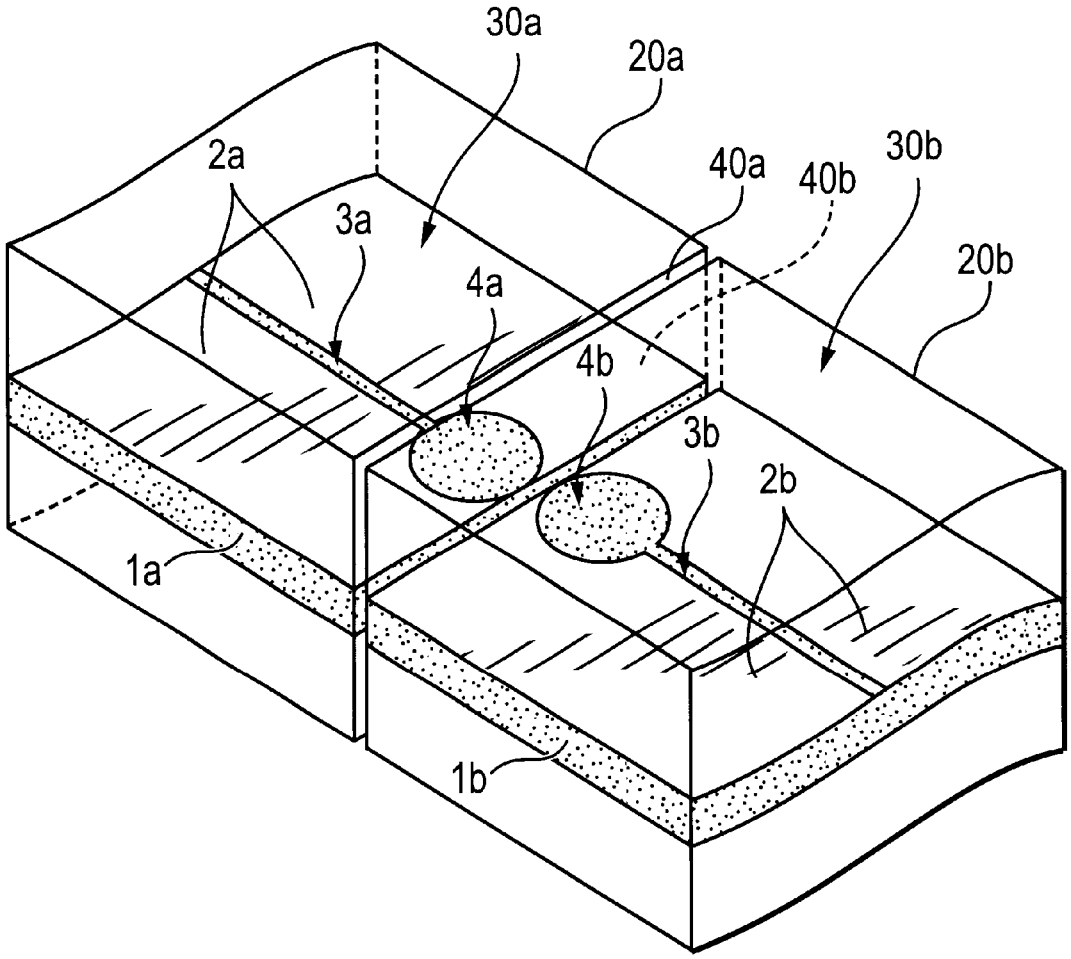
FIG. 14 illustrates the configuration of another embodiment of the present invention.

Similarly, the configurations shown in FIGS. 1A and 1B and 2A and 2B can be applied to fin lines comprising dielectric substrates having slot pattern electrodes formed thereon and arranged in a waveguide. In FIG. 14, the two dielectric substrates 1*a* and 1*b* having the electrode patterns 2*a* and 2*b* shown in FIGS. 1A and 1B are arranged in waveguides 20*a* and 20*b* to form fin lines 30*a* and 30*b*, respectively. The fin lines 30*a* and 30*b* are configured so that the resonator patterns 4*a* and 4*b* are positioned near to each other while the opening faces 40*a* and 40*b* of the two fin lines 30*a* and 30*b* are opposed to each other.

Figure 4A:
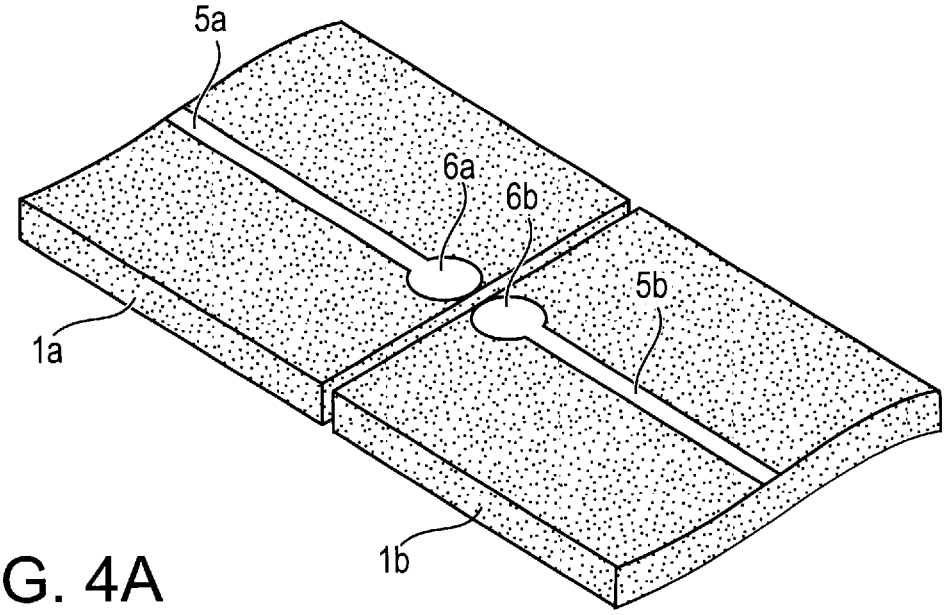
FIGS. 4A and 4B illustrate the configuration of a transmission line connection structure according to a third embodiment of the present invention.
Figure 4B:
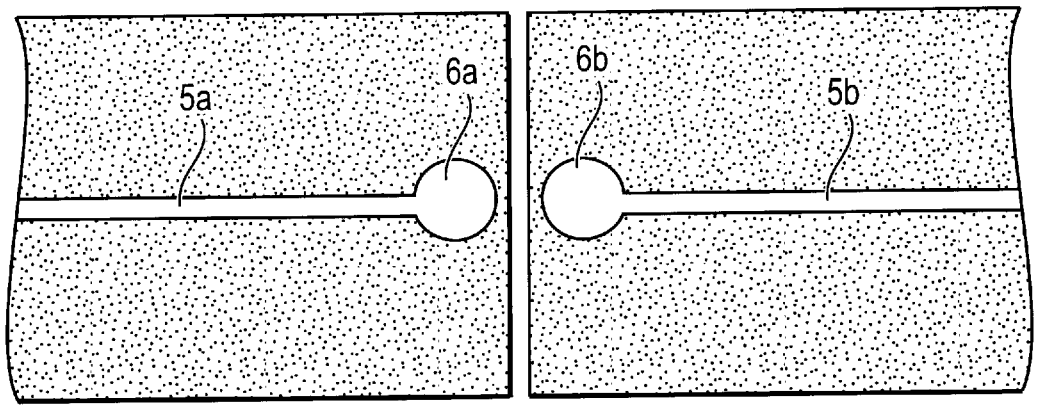

Hereinafter, a transmission line connection structure according to a third embodiment of the present invention will be described in reference to FIGS. 4A and 4B. FIG. 4A is a perspective view showing the major part of the transmission line connection structure, and FIG. 4B is a plan view thereof. In FIGS. 4A and 4B, reference numerals 1*a* and 1*b* designate dielectric substrates, respectively. Differently from the example shown in FIGS. 1A and 1B, strip patterns 5*a* and 5*b* constituting electrodes are formed on the upper faces of the dielectric substrates 1*a* and 1*b*, and ground electrodes are formed on the under faces, respectively, whereby micro strip lines are formed. Resonator patterns 6*a* and 6*b*, each composed of the electrode formed into a circular shape, are provided in the end portions of the strip patterns 5*a* and 5*b*. The resonator patterns 6*a* and 6*b*, the ground electrodes on the under faces, and the dielectric substrates constitute resonators operable in a TM110 mode. The two micro strip lines and the resonators are directly connected, respectively, and the resonators are electromagnetically coupled to each other. Thus, the two micro strip lines are connected to each other via coupling of the resonators.

Figure 5A:
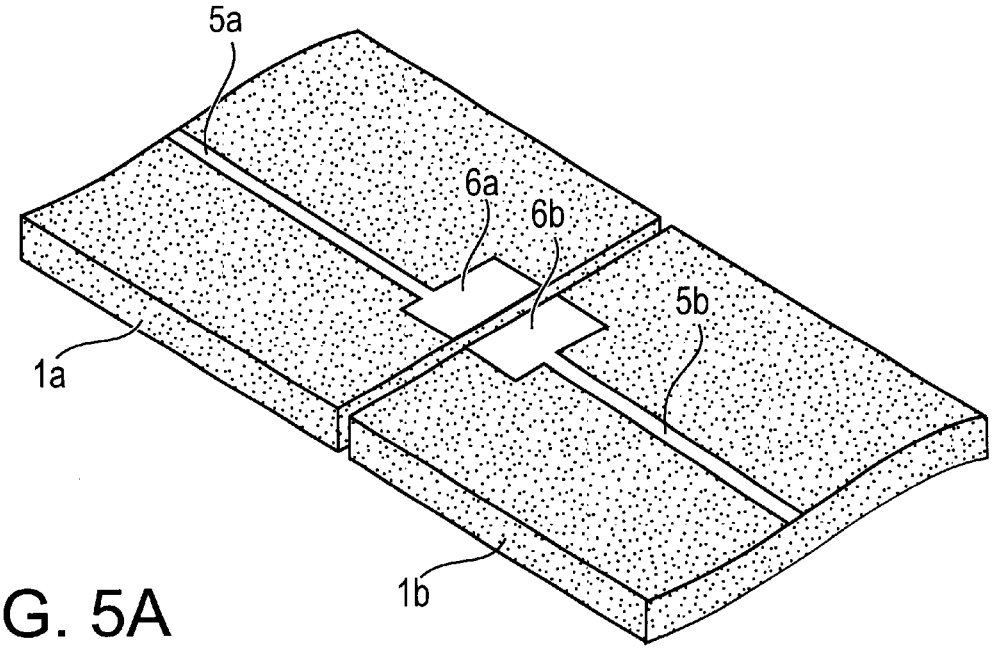
FIGS. 5A and 5B illustrate the configuration of a transmission line connection structure according to a fourth embodiment of the present invention.
Figure 5B:
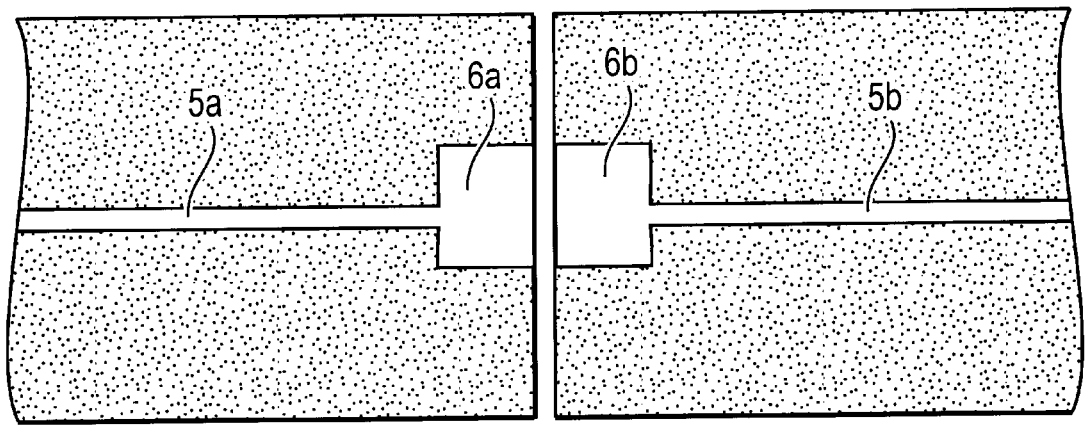

FIGS. 5A and 5B are a perspective view and a plan view showing a transmission line connection structure according to a fourth embodiment of the present invention. Differently from the connection structure of FIGS. 4A and 4B, resonator patterns 6*a* and 6*b* are formed into rectangular shapes, so that the opposed areas of the resonators are increased, which enhances the coupling degree between the resonators.

In the examples of FIGS. 4A and 4B and 5A and 5B, the strip patterns are formed on the upper faces of the dielectric substrates, and the ground electrodes are formed on the under faces, whereby the micro strip lines are formed. However, the above-described configuration may also be applied to a transmission line connection structure in which micro strip lines each comprise a strip pattern formed inside of a dielectric layer, and ground electrodes formed on the upper and under faces thereof. That is, the transmission line connection structure may be configured so that other dielectric plates having ground electrodes formed on the upper surfaces thereof are laminated to the upper faces of the dielectric substrates 1*a* and 1*b* shown in FIGS. 4A and 4B or FIGS. 5A and 5B, respectively.

Moreover, the present invention may be applied to a transmission line connection structure in which dielectric substrates each having a strip pattern formed only on one face are arranged between parallel conductor planes to form a suspended line. That is, the transmission line connection structure may have the configuration in which the ground electrode plates are arranged above and under the dielectric substrates shown in FIGS. 4A and 4B or FIGS. 5A and 5B, at predetermined distances therefrom.

The present invention may further be applied to a transmission line connection structure in which an electrode pattern is formed on only one face of each dielectric substrate to form a coplanar guide. That is, a ground electrode is formed on the upper face of each dielectric substrate, a strip pattern is formed at a predetermined distance from the end of the ground electrode, and a resonator similar to the resonator shown in FIGS. 4A and 4B and FIGS. 5A and 5B is formed in the end portion of the strip pattern.

Moreover, regarding the configuration of the above-described coplanar guide, the ground electrode may be formed on the under face of the dielectric plate, whereby a grounded coplanar guide is formed.

Figure 6A:
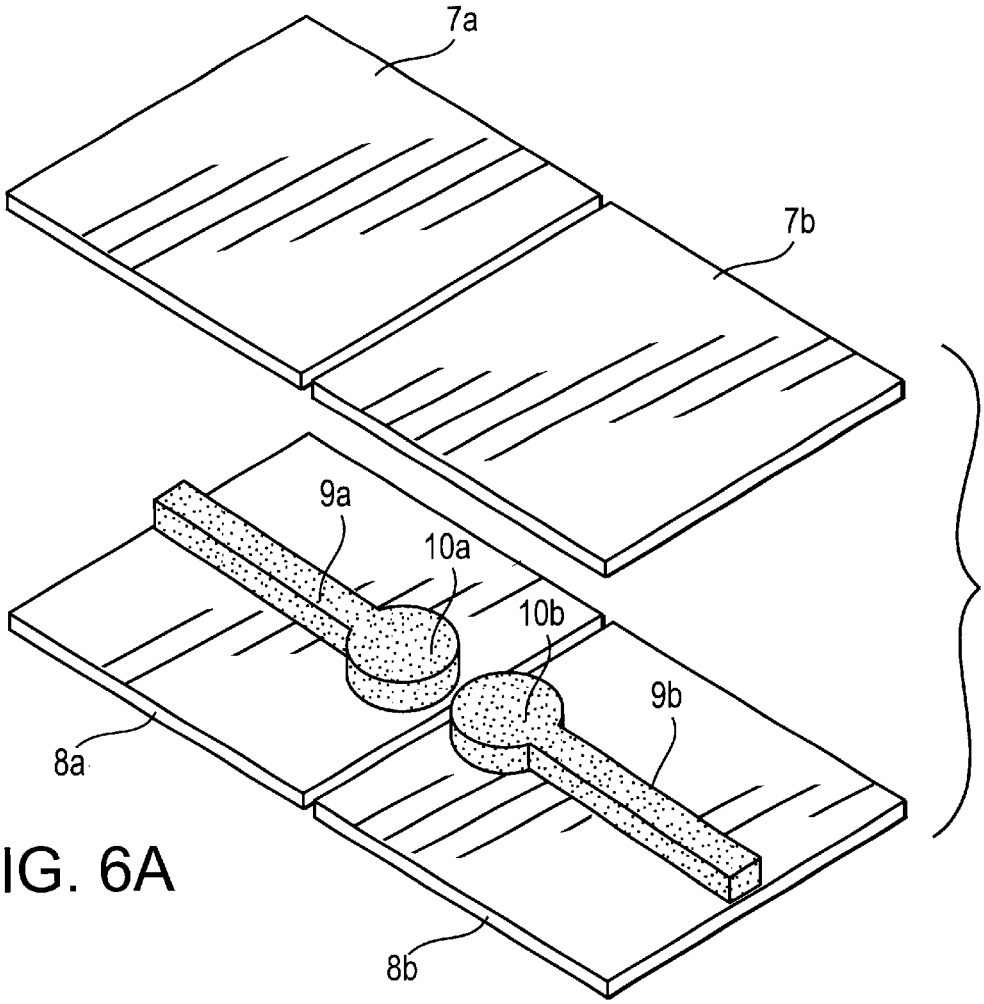
FIGS. 6A and 6B illustrate the configuration of a transmission line connection structure according to a fifth embodiment of the present invention.
Figure 6B:
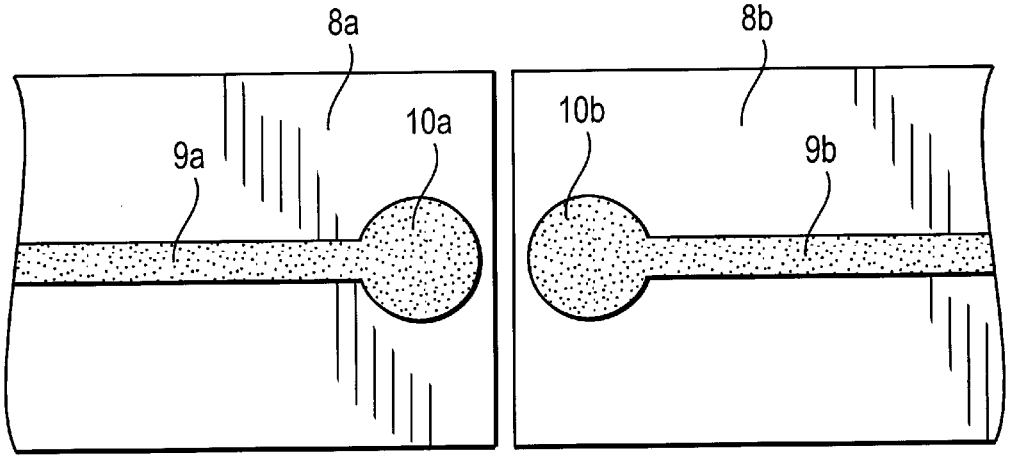

Hereinafter, a transmission line connection structure according to a fifth embodiment of the present invention will be described in reference to FIGS. 6A and 6B. FIG. 6A is a perspective view showing the major part of the transmission line connection structure with the upper conductor plates being separated. FIG. 6B is a plan view of the transmission line connection structure with the upper conductors removed. As shown in FIGS. 6A and 6B, dielectric strips 9*a* and 9*b* are arranged between lower conductor plates 8*a* and 8*b* and upper conductor plates 7*a* and 7*b*. The parallel conductor planes made of the upper and lower conductor plates and the dielectric strips arranged between the parallel conductor planes constitute dielectric transmission lines.

The end portions of the dielectric strips 9*a* and 9*b* are formed in a columnar (in this embodiment, cylindrical) shape, respectively. These portions and the upper and lower conductor plates form dielectric resonators. These two dielectric resonators are arranged in the end portions of the conductor plates and in the ends of the dielectric transmission lines, respectively. The two dielectric transmission lines are arranged in such a manner that the dielectric resonators are positioned near to each other. Thus, the two resonators are electromagnetically coupled to each other. Since the resonators are connected directly to the corresponding dielectric lines, respectively, the two transmission lines are connected via the two resonators.

Figure 7A:
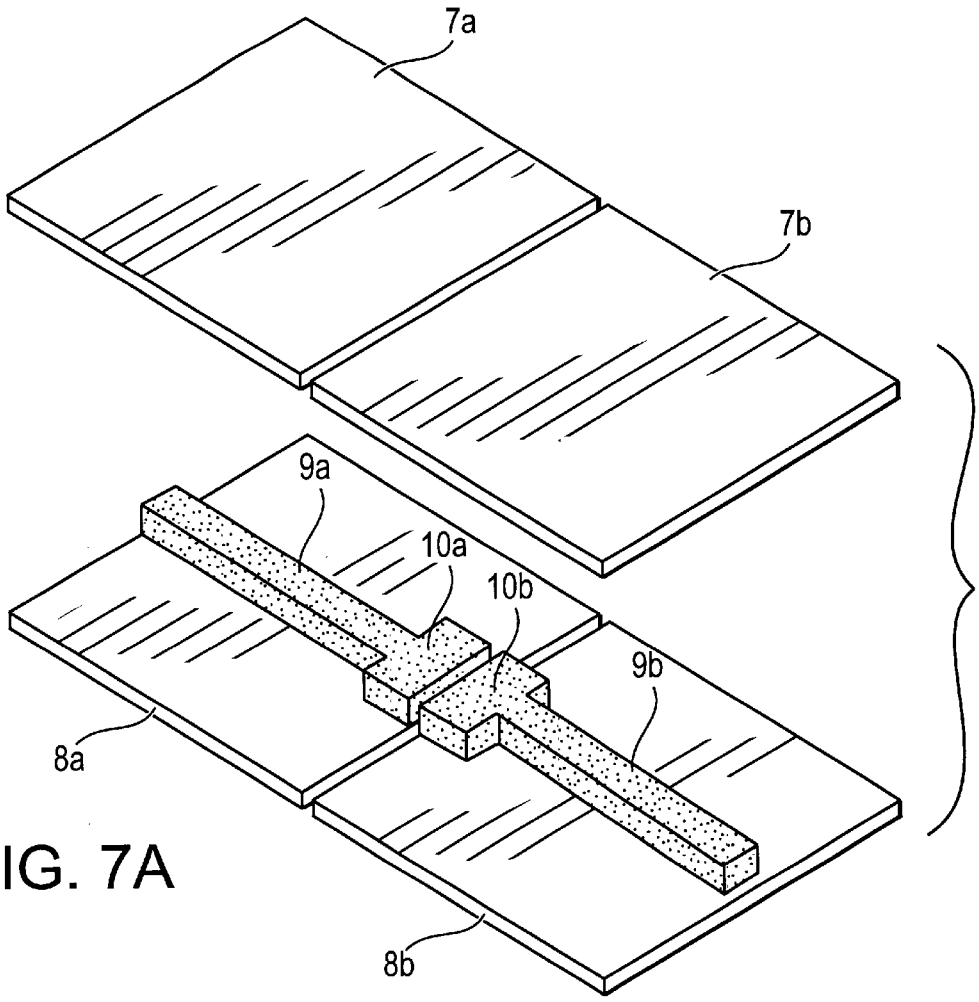
FIGS. 7A and 7B illustrate the configuration of a transmission line connection structure according to a sixth embodiment of the present invention.
Figure 7B:
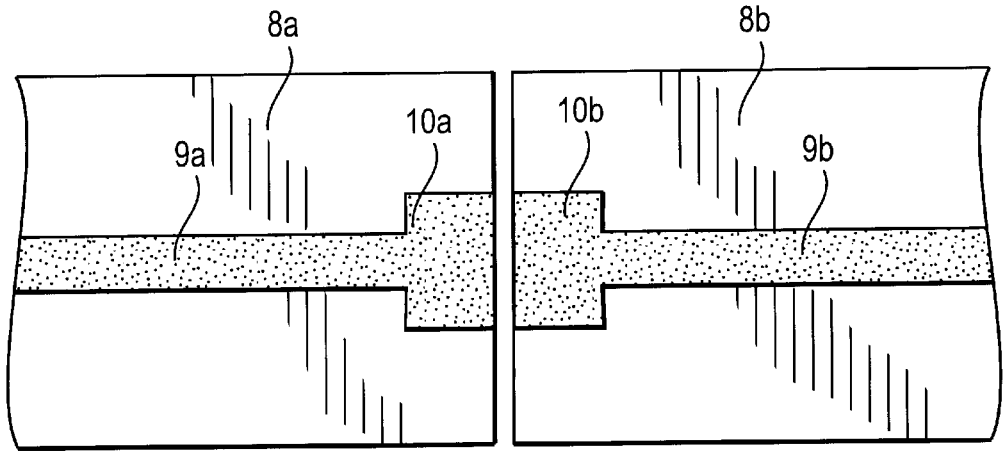

FIGS. 7A and 7B are a perspective view and a plan view showing a transmission line connection structure according to a sixth embodiment of the present invention. Differently from the transmission line connection structure shown in FIGS. 6A and 6B, in this example, the end portions of the dielectric strips are formed into a prism shape, respectively, to form dielectric resonators. The dielectric substrates resonate in a mode different from that of FIG. 6, corresponding to the shapes thereof, and are electromagnetically coupled to each other. Since these resonators and the relevant dielectric lines are connected directly to each other, the two dielectric lines are connected via the two resonators provided between them.

In the examples of FIGS. 6A and 6B, and FIGS. 7A and 7B, the interval between the upper and lower conductor plates in the respective dielectric strip portions is equal to the interval between the conductor plates in both of the spaces at the sides of the dielectric strips, whereby a so-called normal NRD guide is formed. A so-called hyper NRD guide may also be formed, in which the interval between the conductor plates in the cutoff area (non-propagation area) is smaller than the interval between the conductor plates in the respective dielectric strip portions (propagation area), in which a wave in the single LSM01 mode can be propagated. In this latter case, the interval between the conductor plates may be increased at the peripheries of the dielectric resonators, so that the dielectric resonators have a reduced ability to confine an electromagnetic field, which enhances the coupling degree between the adjacent dielectric resonators.

Hereinafter, a transmission line connection structure according to a seventh embodiment of the present invention will be described in reference to FIGS. 8A and 8B.

Figure 8A:
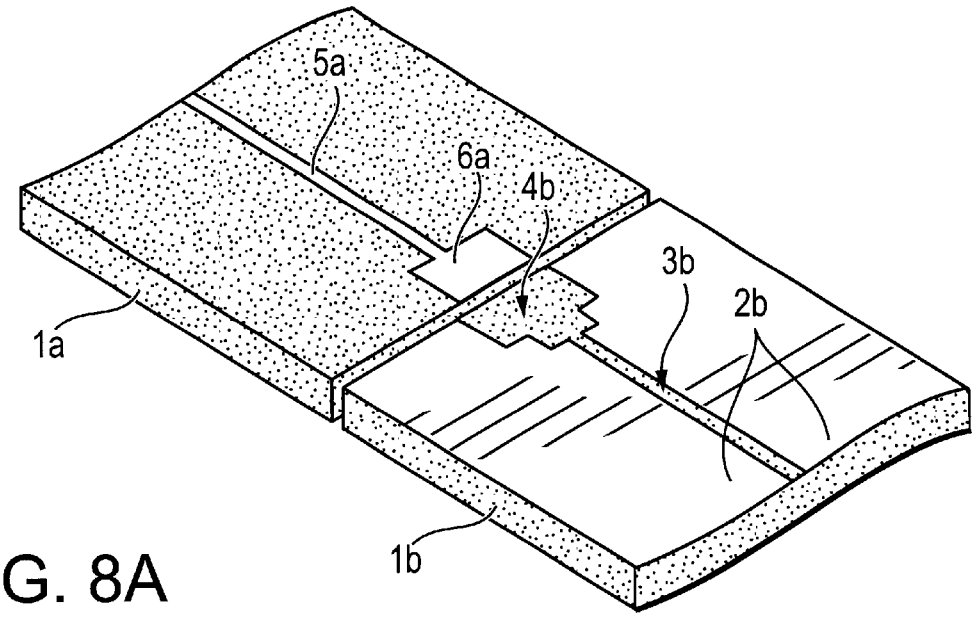
FIGS. 8A and 8B illustrate the configuration of a transmission line connection structure according to a seventh embodiment of the present invention.
Figure 8B:
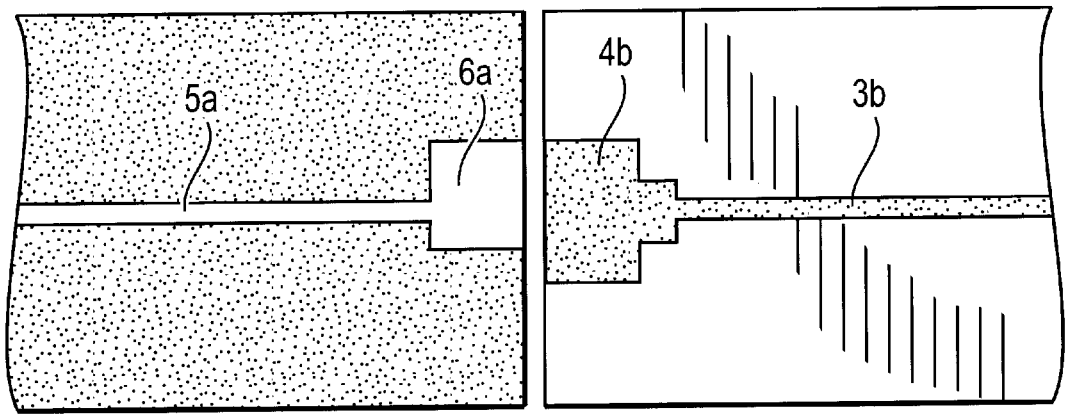

FIGS. 8A and 8B are a perspective view and a plan view showing the major part of the transmission line connection structure. Here, a strip pattern 5*a* and a resonator pattern 6*a* are formed on the upper face of one of the dielectric substrates 1*a*, and a ground electrode is formed on the under face thereof. An electrode 2*b* comprising a slot pattern 3*b* and a resonator pattern 4*b* is formed on the upper face of the other dielectric substrate 1*b*. The resonator comprising the resonator pattern 6*a* and the resonator comprising the resonator pattern 4*b* are positioned near to each other. In this structure, different types of the resonators are electromagnetically coupled to each other. Accordingly, the micro strip line and the slot line, which are different types of transmission lines, are connected to each other.

In addition to the combination of the different types of transmission lines shown in FIGS. 8A and 8B, the resonators contained in a combination of different types of transmission lines such as micro strip lines, slot lines, coplanar guides, PDTL, fin lines, suspended lines, dielectric lines, and so forth can likewise be coupled, so that the different types of transmission lines can be connected to each other.

Hereinafter, an example of the configuration of a high frequency module according to an eighth embodiment of the present invention will be described in reference to FIG. 9.

Figure 9:
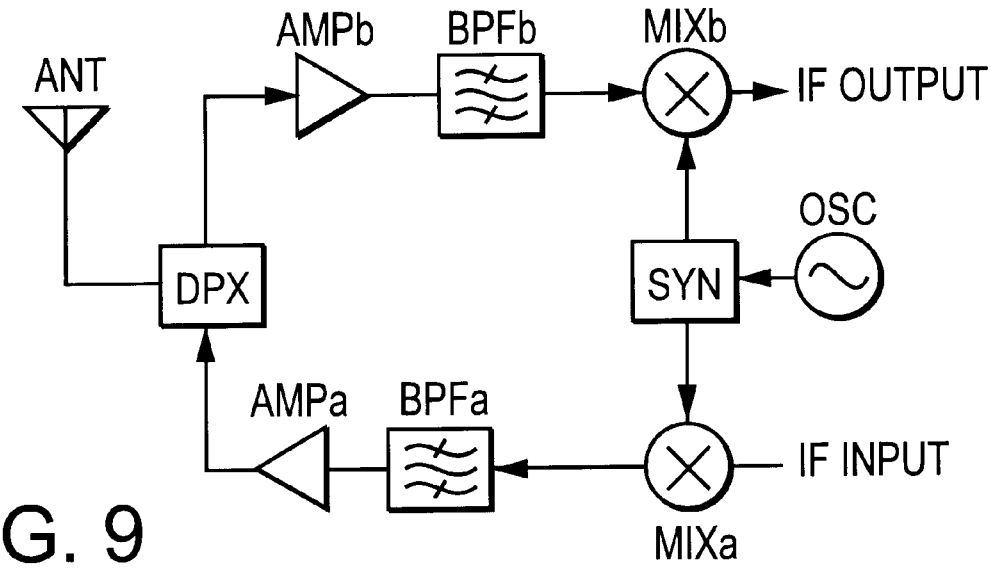
FIG. 9 is a block diagram showing an example of the configuration of a high frequency module according to an eighth embodiment of the present invention.

In FIG. 9, a transmission—reception antenna ANT, a duplexer DPX, band-pass filters BPFa and BPFb, amplification circuits AMPa and AMPb, mixers MIXa and MIXb, an oscillator OSC, and a frequency synthesizer SYN are shown.

The mixer MIXa mixes an intermediate frequency signal IF with a signal output from the frequency synthesizer SYN. The band-pass filter BPFa transmits only a signal in a transmission frequency band of the mixed output signals from the mixer MIXa. The amplification circuit AMPa power-amplifies the signal and sends it via the antenna ANT. The amplification circuit AMPb amplifies a reception signal output from the duplexer DPX. The band-pass filter BPFb transmits only a signal in the reception frequency band in the signal. The mixer MIXb mixes a frequency signal output from the synthesizer SYN with the reception signal and outputs an intermediate frequency signal IF.

In the high frequency module, the transmission line connection structure having any one of the above-described structures is applied to the connection portions between transmission lines in any of the respective parts of the high frequency module. Thereby, in the high frequency module, adjustment and exchange on a component level can be easily carried out. Moreover, the production efficiency of the high frequency module is enhanced.

Figure 10:
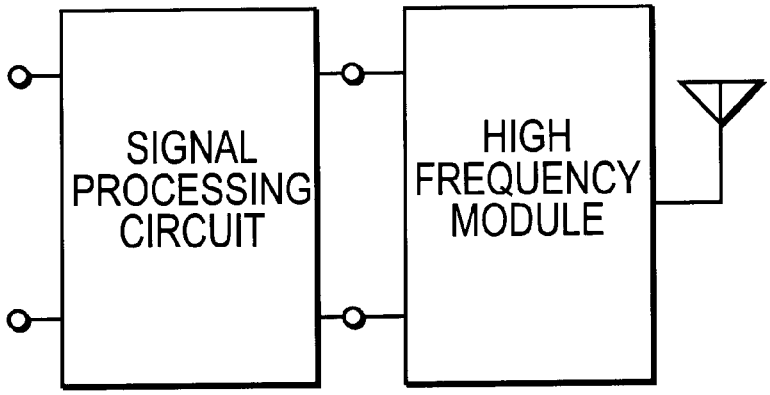
FIG. 10 is a block diagram showing the configuration of a communication device according to a ninth embodiment of the present invention.
Figure 11A:
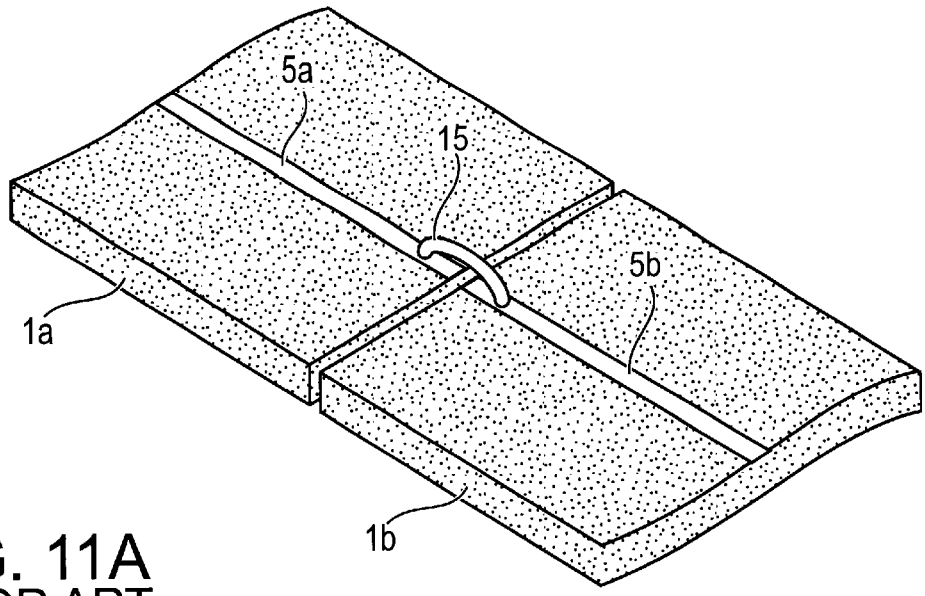
FIG. 11A PRIOR ART
FIGS. 11A and 11B illustrate the configuration of a conventional transmission line connection structure.
Figure 11B:
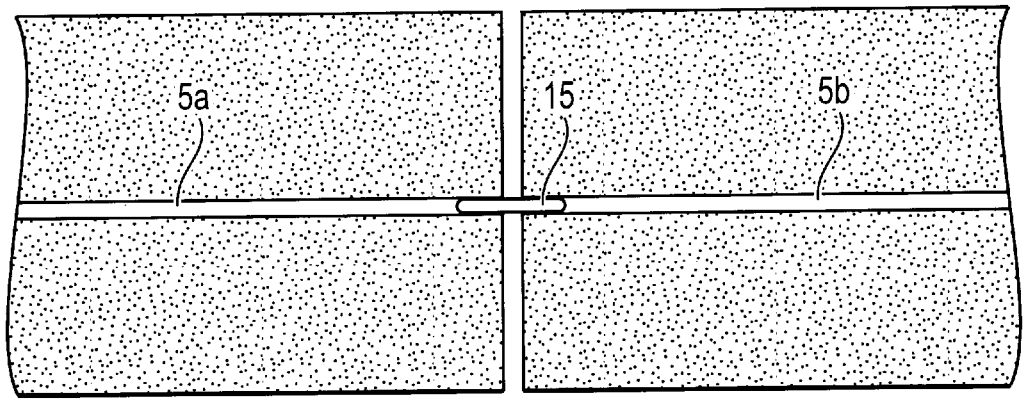
FIG. 11B PRIOR ART
Figure 12A:
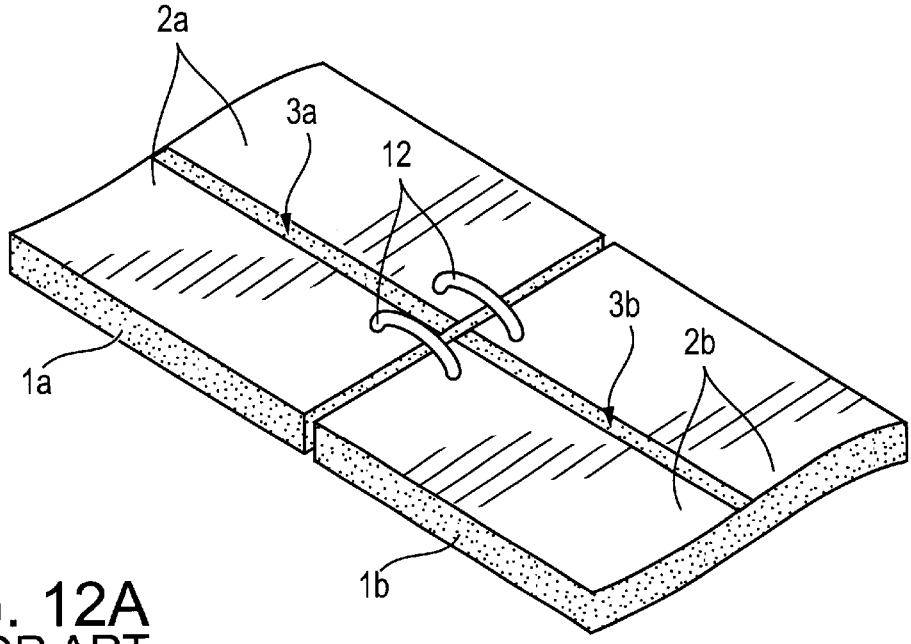
FIG. 12A PRIOR ART
FIGS. 12A and 12B illustrate the configuration of another conventional transmission line connection structure.
Figure 12B:
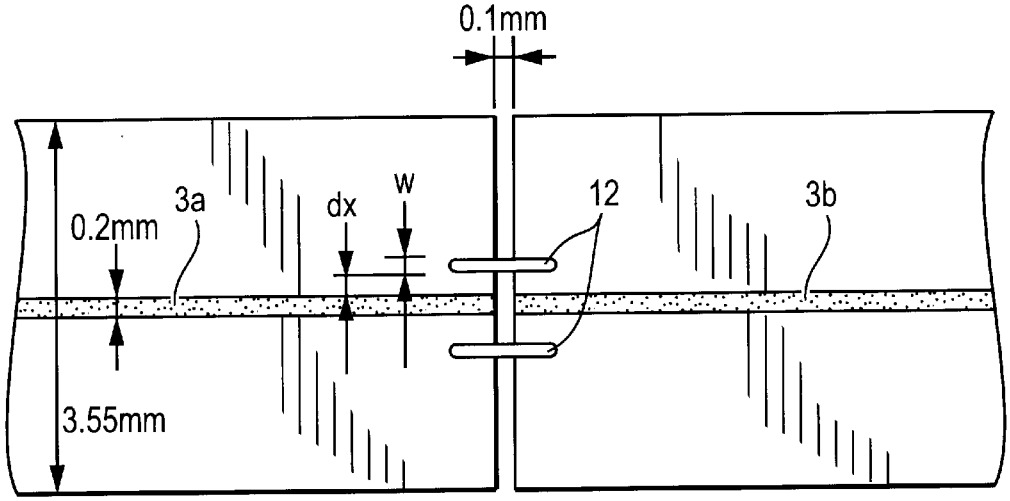
FIG. 12B PRIOR ART
Figure 13:
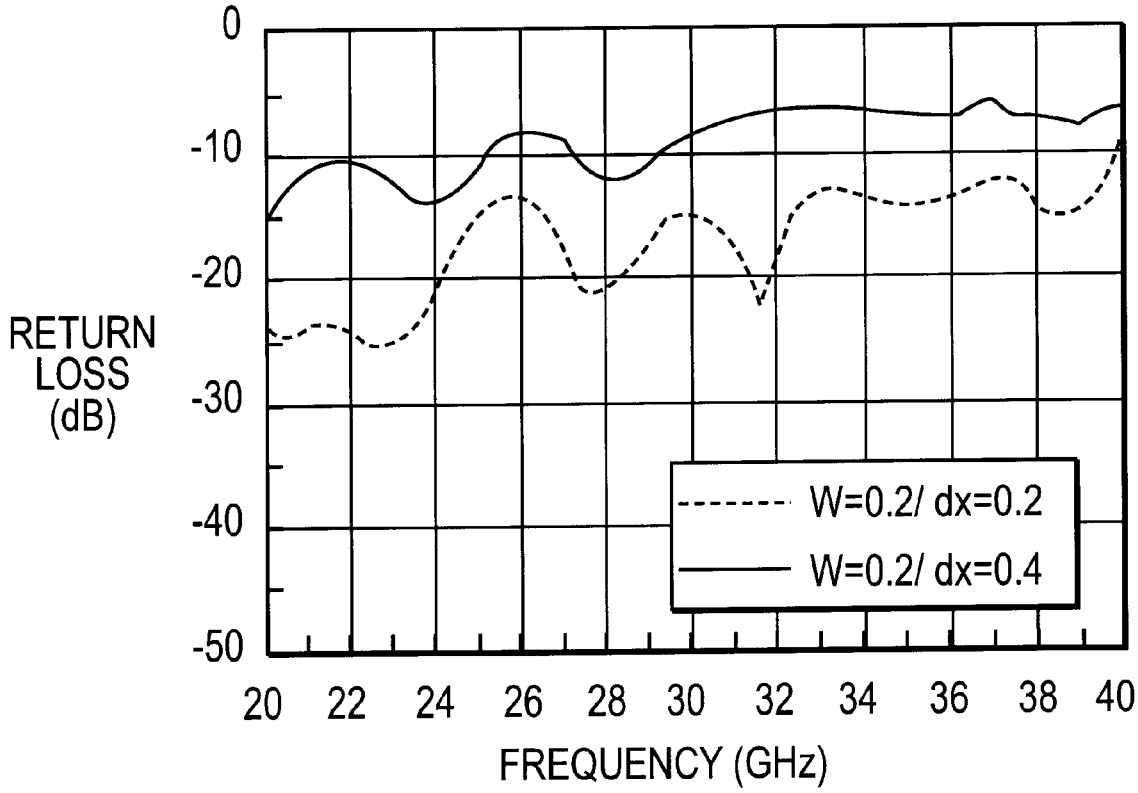
FIG. 13 PRIOR ART
FIG. 13 is a graph showing the frequency characteristic of the transmission line connection structure.

FIG. 10 is a block diagram showing the configuration of a communication device according to a ninth embodiment of the present invention. Here, as the high frequency module, a circuit having the arrangement shown in FIG. 9 is used. As a signal processing circuit, a circuit for transmitting—receiving a signal and processing transmission and reception signals is provided. The whole of the configuration of FIG. 10 carries out radio wave communication of an analog signal or digital data in a microwave or millimeter wave band.

The above-described communication device may be applied not only as device for carrying out radio-wave communication between one-to-one or one-to-many corresponding devices, but also as a one-way communication device such as a millimeter wave radar.

According to the present invention, it is unnecessary to connect the conductors of two transmission lines by use of a wire or ribbon. That is, the transmission lines can be connected, and not affected by a parasitic component caused by the wire or ribbon. Moreover, since the transmission lines are arranged in such a manner that the resonators in the end portions of the transmission lines are positioned near to each other, the connection—release of the transmission lines can be repeatedly carried out. Furthermore, the resonators are arranged in the end portions of the structural bodies of the transmission lines. When the two transmission lines are connected to each other, the resonators are positioned near to each other and are directly coupled. Thus, the resonators are strongly coupled, so that a low insertion loss can be obtained in a wide band.

Advantageously, different types of transmission lines employing different transmission modes can be connected.

Also, the high frequency module may be formed, in which the transmission line connection structure of the present invention used for connecting the transmission lines which connect the components of the high frequency module. Thus, adjustment or exchange of the parts becomes possible. A high frequency module having a predetermined function can be easily obtained.

Furthermore, a communication device such as a mobile communication device, a millimeter wave radar device, or the like may be formed by use of the above high frequency module. Thus, a device having high reliability of connection between transmission lines can be obtained. Moreover, the production efficiency of the whole of the device can be enhanced.

Although the present invention has been described in relation to particular embodiments thereof, many other variations and modifications and other uses will become apparent to those skilled in the art. Therefore, the present invention is not limited by the specific disclosure herein.

What is claimed is:

1. A transmission line connection structure for connecting a pair of transmission lines to each other, each transmission line having a respective structural body, said connection structure comprising a pair of resonators each of which is integrally connected to an end of a different one of the pair of transmission lines and arranged at end portions of the respective structural bodies, wherein said end portions of the structural bodies corresponding to portions of the transmission lines to be connected to each other are positioned near to each other along a longitudinal axis such that the resonators and thereby the transmission lines are electromagnetically coupled to each other.

2. A transmission line connection structure according to claim 1, wherein the transmission lines each comprise an electrode having a slot pattern formed on a dielectric substrate.

3. A transmission line connection structure according to claim 1, wherein the transmission lines each comprise a strip-shaped electrode formed on a dielectric substrate.

4. A transmission line connection structure according to claim 1, wherein the transmission lines each comprise a dielectric strip arranged between two substantially parallel conductor planes.

5. A transmission line connection structure according to claim 1, wherein the two transmission lines to be connected are different types of transmission lines.

6. A high frequency module including the transmission line connection structure defined in any one of claims 1 to 5, and further comprising high-frequency circuits connected respectively to said transmission lines.

7. A communication device including the high frequency module defined in claim 6, wherein said high-frequency circuits include at least one of a transmission circuit and a reception circuit.

8. A transmission line connection structure according to claim 4, wherein at least one of said resonators is substantially circular.

9. A transmission line connection structure according to claim 4, wherein at least one of said resonators is substantially rectangular.

10. A transmission line connection structure according to claim 2, wherein at least one of said resonators is an HE110 resonator.

11. A transmission line connection structure according to claim 2, wherein at least one of said resonators is substantially rectangular.

12. A transmission line connection structure according to claim 2, wherein at least one of said resonators has a substantially rectangular portion and has a width which becomes wider toward said end portion of said respective structural body.

* * * * *